United States Patent [19]

Lowe

[11] Patent Number: 4,676,418

[45] Date of Patent: Jun. 30, 1987

[54] BACKPACK HAVING IMPROVED LOAD DISTRIBUTION AND STABILIZING STRUCTURES

[75] Inventor: Greg E. Lowe, Boulder, Colo.

[73] Assignee: Lowe Alpine Systems, Inc., Broomfield, Colo.

[21] Appl. No.: 839,126

[22] Filed: Mar. 12, 1986

[51] Int. Cl.[4] ..... A45F 3/04

[52] U.S. Cl. ..... 224/215; 224/262

[58] Field of Search ..... 224/209-216, 224/153, 259-263

[56] References Cited

U.S. PATENT DOCUMENTS

| | | | |
|---|---|---|---|
| 4,189,076 | 2/1980 | Zufich | 224/211 |
| 4,214,685 | 7/1980 | Pletz | 224/211 |
| 4,303,186 | 12/1981 | Ollinger, IV | 224/211 |
| 4,318,502 | 3/1982 | Lowe et al. | 224/153 |
| 4,479,595 | 10/1984 | Opsal . | |
| 4,504,002 | 3/1985 | Hall | 224/211 |

FOREIGN PATENT DOCUMENTS

| | | | |
|---|---|---|---|
| 91599 | 5/1958 | Norway | 224/210 |
| 764880 | 1/1957 | United Kingdom | 224/210 |

OTHER PUBLICATIONS

Kelty Pack Catalog, p. 40.

*Primary Examiner*—Stephen Marcus
*Assistant Examiner*—Robert M. Petrik
*Attorney, Agent, or Firm*—Robert E. Harris

[57] ABSTRACT

A frame pack is disclosed that is useful as a body mountable structure for retaining and/or transporting various articles which facilitates both a less restricted range of motion in the hips and shoulders of a user due to the load distribution thereon while maintaining and/or enhancing stability of the pack during use. The pack includes a storage portion mounted on a framework, and a shoulder harness that is attachable to various locations along a vertical member of the framework. The pack includes a load distributing waist harness assembly that has a padded waist belt mounted on a substantially rigid member and a plurality of appendages meeting at a central portion pivotably mounted to a lower, central portion of the frame, with the appendages and the frame having portions for receiving motion restraining members to variably limit pivotal motion. An upper stabilizing assembly is also provided having portions slidably adjustable along guides positioned between the upper and lower portions of the framework and length adjustable stabilizer straps connected to both the adjustable portions and the shoulder harness for minimization of the length of the stabilizer strap in response to choice of placement of the shoulder harness on the framework thereby limiting restriction of the shoulders of the user when the stabilizer straps are tightened while maximizing stability of the pack against swaying at the upper portion thereof.

29 Claims, 30 Drawing Figures

FIG. 11.
FIG. 12.
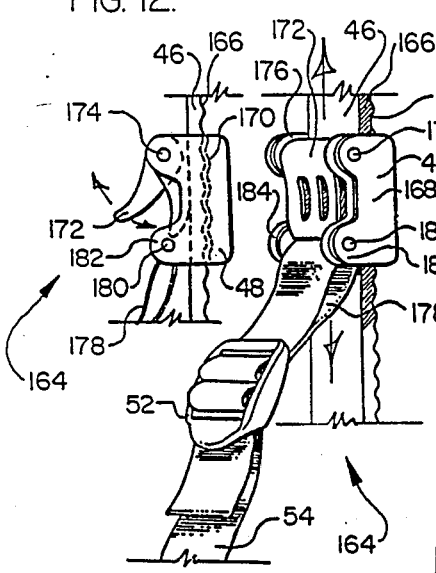
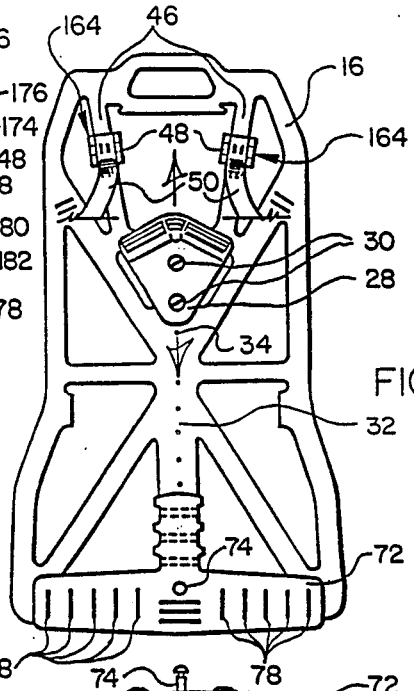
FIG. 4A.
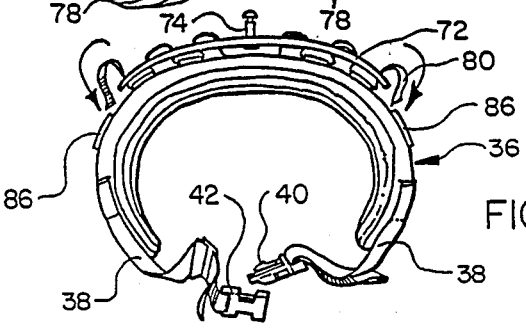
FIG. 4B.
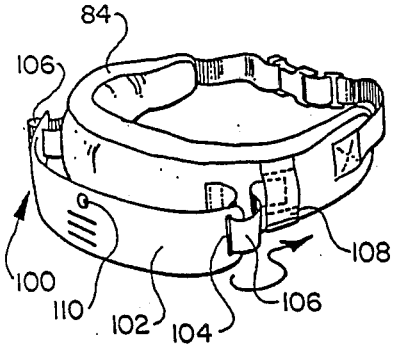
FIG. 7.
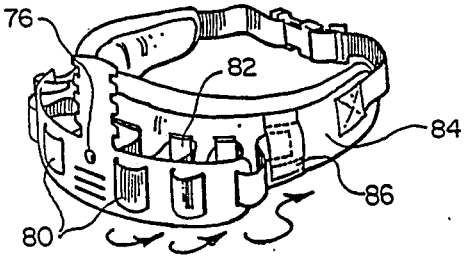
FIG. 5.

FIG. 9A.
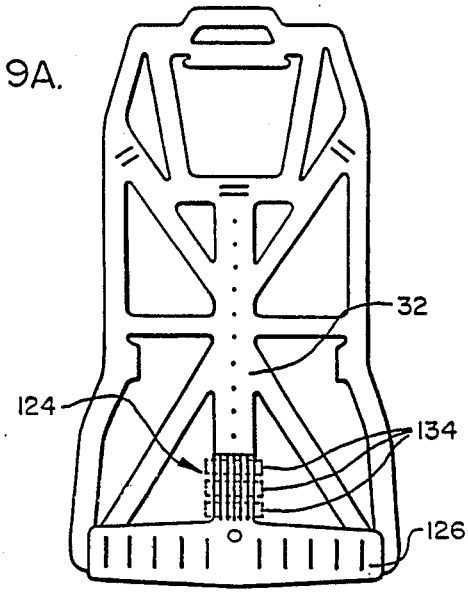
FIG. 9C.
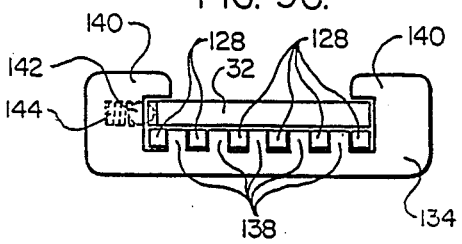
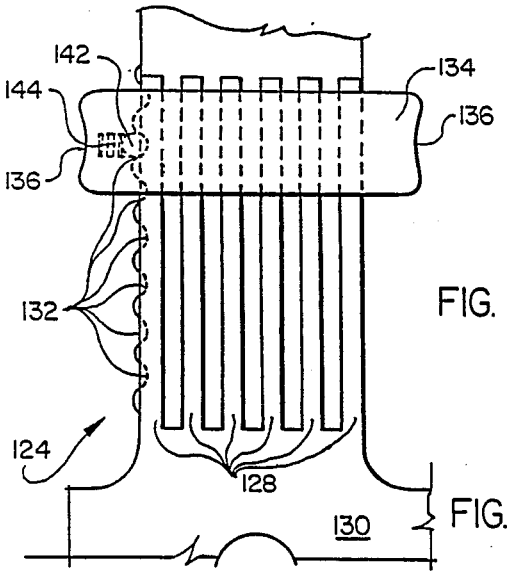
FIG. 9B.
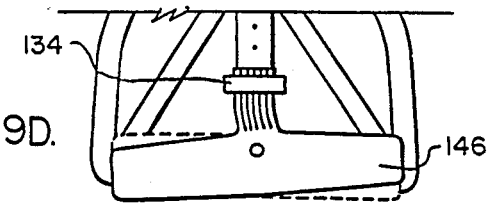
FIG. 9D.
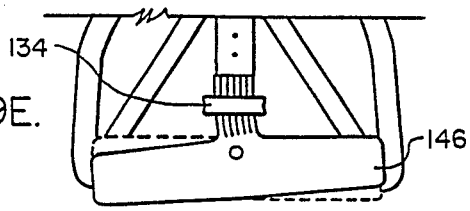
FIG. 9E.
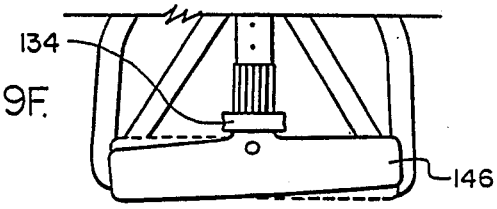
FIG. 9F.

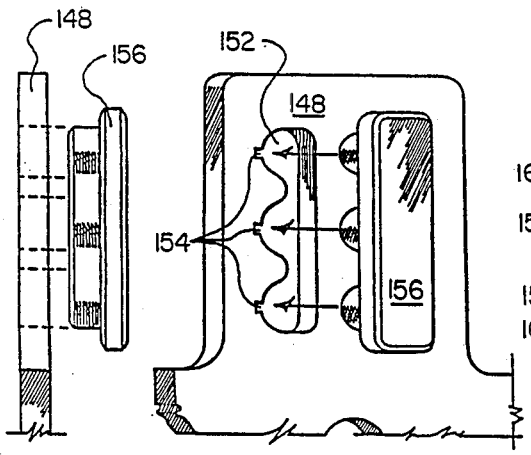
FIG. 10C.
FIG. 10B.
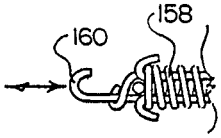
FIG. 10D.
FIG. 10A.
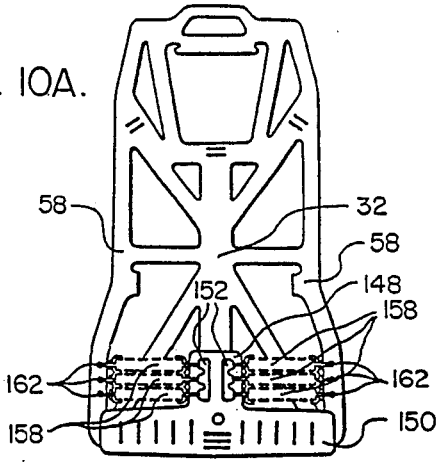
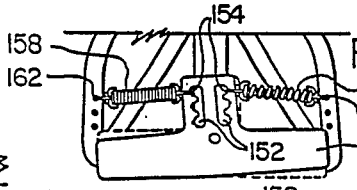
FIG. 10E.
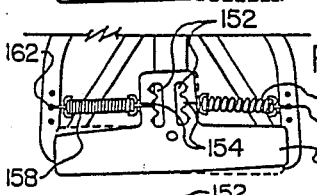
FIG. 10F.
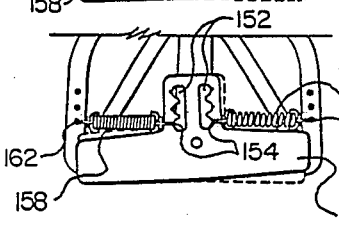
FIG. 10G.

BACKPACK HAVING IMPROVED LOAD DISTRIBUTION AND STABILIZING STRUCTURES

FIELD OF THE INVENTION

This invention relates to a body mountable structure and, more particularly, relates to packs, such as a back pack having a frame and body mounting means.

BACKGROUND OF THE INVENTION

Frame packs, or bags, have been heretofore suggested and/or utilized to retain and/or carry various articles, and such packs have heretofore, included a frame, and centrally pivotal waist harnesses and/or assemblies have also been heretofore suggested and/or utilized in connection with a frame for stabilizing the upper portion of the pack against swaying.

Thus, while various types of frame packs have heretofore been suggested and/or utilized, known packs have not been found to be completely satisfacory, at least for some uses, due at least in part to unduly restricting the normal movements of a user and/or failing to provide adequate stability during normal use.

SUMMARY OF THE INVENTION

This invention provides an improved frame pack for retaining various articles which substantially allows, within limits, normal movement of the shoulders and hips of a user while maintaining and/or enhancing stability of the pack, and therefore the user, while in use. By providing a pack with a pivotable load distributing waist harness having variable pivot restraining members, a user may maintain a greater range of hip motion than was heretofore possible using such packs, and can vary the resistance to hip motion in relation to the weight of the load, resulting in less user fatigue, while still retaining stability of the pack at its lower portions during sudden or difficult maneuvers. By providing a pack with a shoulder harness which may be selectively attached to various positions on the pack framework, the pack may be readily adjusted to users of differing torso length and/or to achieve optimal balance and comfort with respect to articles carried in the pack. By providing a pack with adjustable stabilizer straps responsive to the placement of the shoulder harness on the pack framework, the pack may be stabilized against swaying at its upper portion while minimizing discomfort and restriction of shoulder movement of a user.

It is therefore an object of this invention to provide an improved body mountable structure.

It is another object of this invention to provide an improved frame pack having a shoulder harness which is adjustable relative to the longitudinal axis of the frame.

It is still another object of this invention to provide an improved frame pack having an upper pack stabilizing assembly which is readily adjustable in response to adjustment of the shoulder harness.

It is still another object of this invention to provide a frame pack with a readily adjustable upper pack stabilizing assembly having stabilizer straps adjustable to a minimum length between the shoulders of a user and the pack framework.

It is still another object of this invention to provide a frame pack having a load distributing waist harness assembly pivotably mountable to the pack framework.

It is yet another object of this invention to provide a frame pack having a pivotable load distributing waist harness assembly having variable pivot restraining members.

It is yet another object of this invention to provide a frame pack which limits discomfort and restriction of movement of the hips and shoulders of a user while maintaining and/or enhancing stability of the pack at both its upper and lower regions against swaying due to sudden and/or difficult maneuvers of a user wearing the frame pack.

It is yet another object of this invention to provide a quickly attachable and detachable pack bag assembly which may be released in a quick and easy manner.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate complete embodiment of the invention according to the best mode so far devised for the practical application of the principles thereof, and in which:

FIG. 4A is a partial rear elevation view of the frame portion, shoulder harness mounting portion, upper pack stabilizing assembly and the now preferred embodiment of a portion of the pivotable waist harness assembly of the frame pack shown in FIG. 2;

FIG. 4B is a top elevation view of this waist harness assembly partially shown in FIG. 4A;

FIG. 5 is a perspective view of the waist harness assembly shown in FIG. 4B;

FIG. 7 is a partial perspective view of a second embodiment of the waist harness assembly which may be utilized in this invention;

FIG. 9A is a rear elevation view of a third embodiment of the pivot restraining portion and mounting portion of a waist harness assembly which may be utilized in this invention;

FIG. 9B is an enlarged rear elevation view of the pivot restraining portion of the waist harness assembly shown in FIG. 9A;

FIG. 9C is a top elevation view of the pivot restraining portion of the waist harness assembly shown in FIGS. 9A and 9B;

FIGS. 9D through 9F are partial rear elevation views of frame having the mounting portion and pivot restraining portion, as shown in FIG. 9A mounted thereon;

FIG. 10A is a rear perspective view of a fourth embodiment of portions of the waist harness assembly mounted to the frame portion shown in FIG. 3;

FIG. 10B is an enlarged and exploded perspective view of a part of the mounting portion of the fourth embodiment of the waist harness assembly shown in FIG. 10A which receives the pivot restraining portion thereof;

FIG. 10C is an enlarged and exploded side elevation view of the part of the mounting portion shown in FIG. 10B;

FIG. 10D is a partial side elevation view of the pivot restraining means of the waist harness assembly shown in FIG. 10A;

FIGS. 10E through 10G are partial rear elevation views of the frame having the mounting portion and pivot restraining portion of the waist harness assembly as shown in FIG. 10A, mounted thereon;

FIG. 11 is a detailed perspective view of the upper pack stabilizing assembly as shown in FIG. 2; and FIG. 12 is a side elevation view of the upper pack stabilizing assembly shown in FIG. 11.

DESCRIPTION OF THE INVENTION

Figure 1:
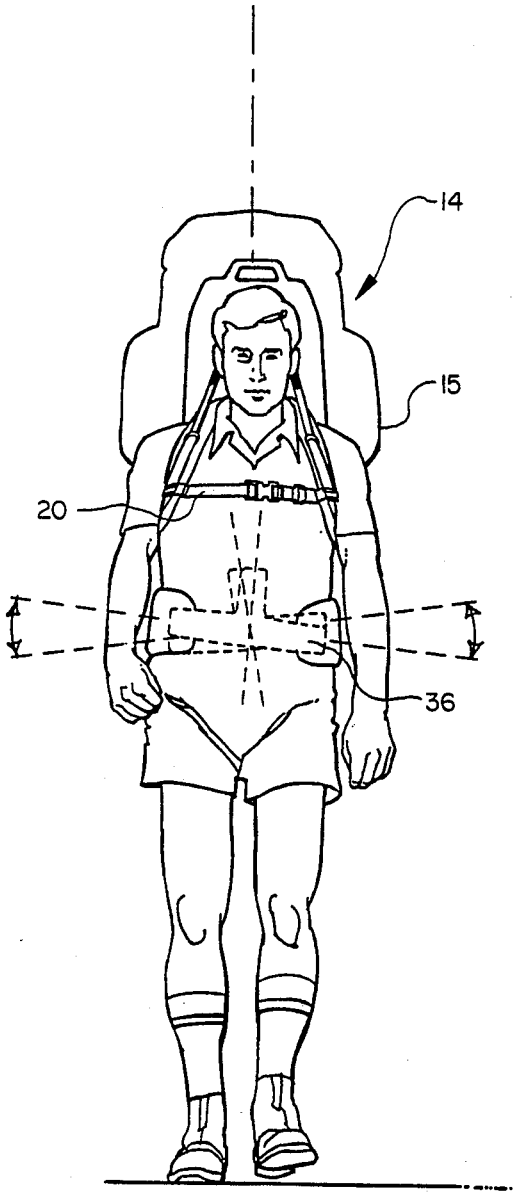
FIG. 1 is a front elevation view illustrating the frame pack of this invention mounted on a user and indicating that pivoting motion is allowed to occur between the lower portion of the pack and the user.
Figure 2:
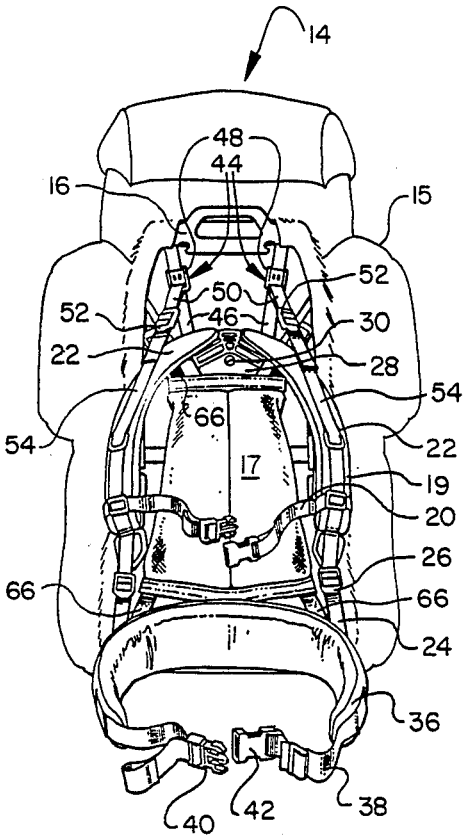
FIG. 2 is a rear elevation view of the frame pack of this invention.

Frame pack 14 is configured to be mounted on the back of a user, as illustrated in FIG. 1, with the longitudinal axis of the pack substantially aligned with the user's torso so that, when positioned on a user, the upper portion of the pack is adjacent to the upper portion of the torso (i.e., the neck of a user), and the lower portion of the pack is adjacent to the middle or lower portion of the torso (i.e., near the belt line of a user), and is configured to carry and/or retain various articles within the receptacle, or chamber, formed by walls 15. Walls 15 can be formed of readily yieldable material (such as nylon, for example), and, as indicated in FIG. 2, can form a plurality of chambers. As also best shown in FIG. 2, pack 14 preferably includes a frame, or framework, 16 (preferably formed of plastic, for example), as well as a back pad 17.

Padded shoulder harness assembly 19 includes a chest strap 20, shoulder pads 22, adjustable lower connector straps 24, and adjustment buckle 26. Yoke 28 is mounted on frame 16 by connector 30 (a screw, for example) and receives shoulder pads 22 at the upper portions thereof as, for example, by stitching. Yoke 28 is longitudinally adjustable along frame 14 by variable placement of the yoke 28 along central frame member 32 (shown in FIG. 3), with yoke 28 being positionable by insertion of connector 30 in any one of the holes 34 in central frame member 32.

Load distributing waist harness assembly 36 includes adjustable belt 38 (having male buckle member 40 and female buckle member 42 at the opposite ends thereof), and upper pack stabilizing assembly 44 (having vertical frame members 46 and slidable height adjustment means 48 connected with webbing 50 which is connected by buckles 52 in an adjustable relationship with tension adjustable oscillation restraint straps 54 which are mounted on shoulder pads 22 as, for example, by stitching).

Figure 3:
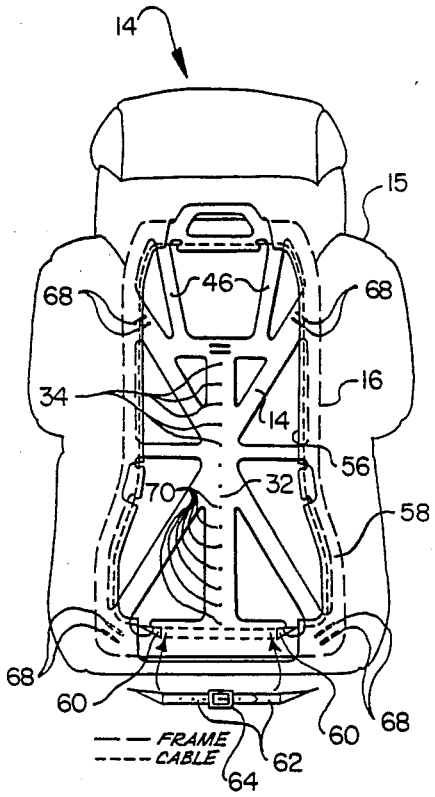
FIG. 3 is a rear elevation view of the storage portion and frame portion of the frame pack shown in FIG. 2.

The receptacles formed by walls 15, utilized in conjunction with frame 16, are best shown in FIG. 3 which illustrates that the receptacles are preferably formed by fitting flap 56 over the external frame portions 58 of frame 16 and drawing flap 56 tight thereabout with continuous cable 60 stitched into flap 56. Adjustable straps 62 are connected, for example, by stitching, at the ends of cable 60 at the lower portion of pack 14 to thereby maintain cable 60 tightly drawn by means of buckle 64.

FIG. 3 also illustrates the means for holding back pad 17 into place on the frame. Back pad straps 66, extending from the four corners of back pad 17 (shown in FIG. 2), are receivable in slots 68 in frame 16. Also illustrated, are height adjustment holes 70 in the lower portion of frame member 32 for centrally receiving connecting means, for example a screw, through load distributing waist harness assembly 36 thereby allowing height adjustment of harness assembly 36.

The placement of yoke 28 is best illustrated in FIG. 4. As shown, yoke 28 is positioned on central frame member 32 by connecting means 30 so that yoke 28 is thereby vertically adjustable along frame 16 (when member 32 is vertically positioned).

The now preferred embodiment of load distributing waist harness assembly 36 is shown in FIG. 4. Waist harness assembly 36 includes mounting plate 72 (shown attached to frame 16 and outwardly attached to assembly 36), attachable to frame 16 at the lower portions thereof by mounting screw and nut 74 through center hole 76. Mounting plate 72 includes vertical belt slots 78 for receipt of connector belt 80.

As shown more clearly in FIG. 5, connector belt 80 is threaded through slots 78, and then through loops 82 attached, as for example by stitching, to padded belt 84. Connector belt 80 terminates in pockets 86 (shown in both FIGS. 4 and 5) being maintained therein by, for example, Velcro strips. Waist harness assembly 36 is also shown to include waist belt 38 stitched to either side of padded belt 84 and maintained around the waist of a user by male and female buckle sections 40 and 42, which buckles have adjustment means for changing the length of belts 38 integral thereto.

Figure 6A:
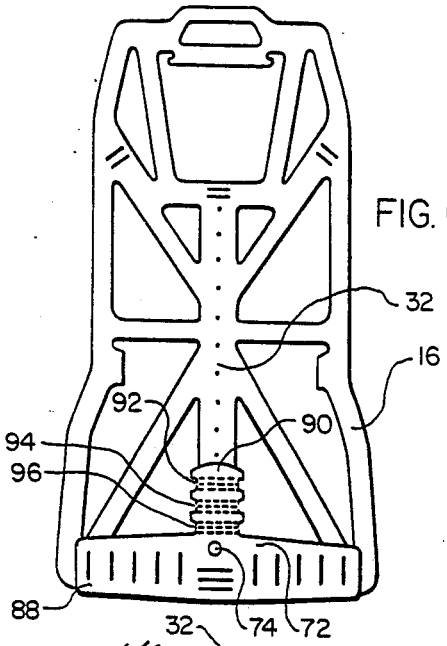
FIGS. 6A through 6D are rear elevation views (with FIGS. 6B through 6D being partial views) of the frame having the mounting portion and pivot restraining portions of the waist harness assembly as shown in FIG. 4A, mounted thereon.

Referring specifically to the function of waist harness assembly 36 shown in FIGS. 4 and 5, FIG. 6A shows mounting plate 72 in place on frame 16 at its lower portions. Mounting plate 72 is an inverted T-shaped member having a horizontal portion 88 and a vertical portion 90. Horizontal portion 88 is of a length to substantially span the width of the lower back of a user. Vertical portion 90 of mounting plate 72 is seen to be adjacent to the lower portions of centrally located frame member 32, and includes a serious of indented portoins 92, 94 and 96.

Figure 6B:
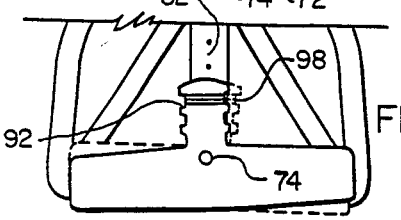
Figure 6C:
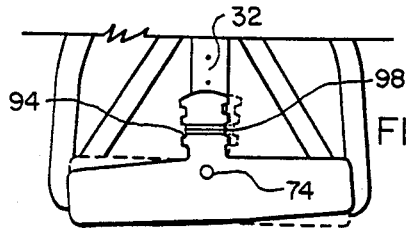
Figure 6D:
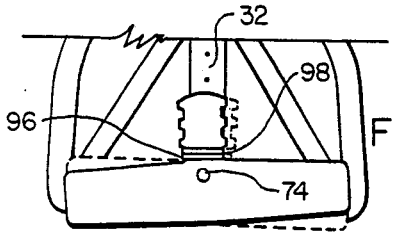

Referring now to FIGS. 6B, 6C and 6D, it is shown that mounting plate 72 is pivotable on mounting screw 74 (as shown by illustrating its initial position and a second position, the initial position being shown by dotted segments of plate 2 and a second position being shown by solid line segments). Since paded belt 84 (as shown in FIG. 5) is connected to the mounting plate by connector belt 80 (as also shown in FIG. 5), it is therefore illustrated that while belt 38 is secured around the waist of a user, waist harness assembly 36 will be pivotable in response to the hip motions of a user while walking as illustrated in FIG. 1.

By placement of a resilient band (an elastic cord or the like, for example) around the vertical portion 90 of mounting plate 72 and frame member 32, variable restraint of pivoting motion is achieved so as to maintain stability of the lower portion of frame pack 10 against sudden or difficult maneuvers by a user.

More particularly, band 98, as shown in FIG. 6B, is placed about the vertical portion 90 of mounting plate 72 and about the lower portion of vertical frame member 32. When, as shown in FIG. 6B, band 98 is placed therearound and within indentation 92, maximum pivotal restraint is achieved. As shown in FIG. 6C, band 98 may also be placed in middle indentation 94 for a medium pivotal restraint, while, as shown in FIG. 6D, when band 98 is placed at the lowest indentation 96, minimum pivotal restraint is achieved.

FIG. 7 illustrates a second embodiment 100 of load distributing waist harness assembly. As shown, mounting plate 102 is connected to received padded belt 84 by connector straps 106 through mounting slots 104. Connector straps 106 are shown to be connected to padded belt 84, as, for example, by stitching and terminate in pockets 108 and are secured therein, as for example, by Velcro strips.

Figure 8A:
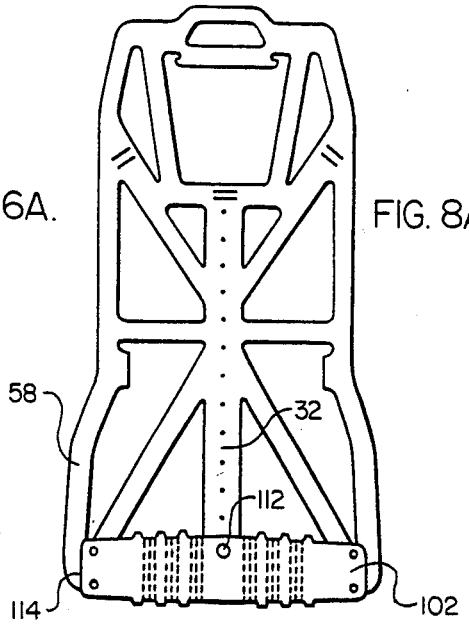
FIGS. 8A through 8D are rear elevation views (with FIGS. 8B through 8D being partial views) of the frame having the mounting portion and pivot restraining portions of the waist harness assembly, as shown in FIG. 7, mounted thereon.

Mounting plate 102 has a centrally located mounting hole 110. As shown in FIG. 8A, mounting plate 102 is maintained on vertical frame member 32 by mounting pin 112 through mounting hole 110. Mounting plate 102 includes indentations on either side of mounting pin 112 equidistant therefrom on each side, and is adjacent to bottom section 114 of outside frame portions 58.

Figure 8B:
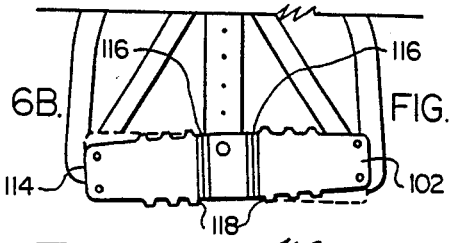
Figure 8C:
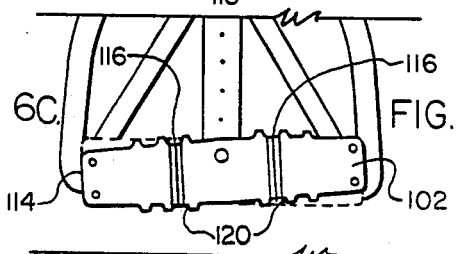
Figure 8D:
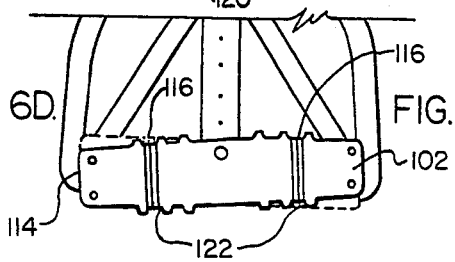

As shown in FIG. 8B, when resilient bands are placed around mounting plate 102 and lower frame section 114 in indentations 118, minimum resistance to pivotal motion of plate 102 on pin 112 is achieved. When placed in middle indentations 116, as shown in FIG. 8C, a medium resistance to pivotal motion is achieved, while placement of band 116 in outside indentations 122 achieves maximum resistance to pivotal motion, as shown in FIG. 8D.

FIGS. 9A through 9F illustrate a third embodiment of the load distributing waist harness assembly wherein most elements of the waist harness assembly are identical to the assembly illustrated in FIGS. 4 and 5. However, vertical portion 124 or mounting plate 126 of FIG. 9A is shown to include a plurality of vertical fingers 128 connected to a base section 130, as more clearly illustrated in FIG. 9B. Vertical fingers 128 are adjacent to vertical frame member 32, and are constructed of a strong, resilient plastic material. Vertical frame member 32 has a series of detents 132 along one edge thereof.

Slide 134, having indented grippin sections 136 on either side thereof, is maintained over fingers 128 in a slidable relationship therewith. As shown in FIG. 9C, slide 134 incldues spreaders 138 positioned between fingers 128 and is maintained around both fingers 128 and vertical frame member 32 by end portions 140. Slide 134 is adjustable along the length of fingers 128 by gripping slide 134 at indentations 136 and forcing slide 134 vertically along frame member 32.

Slide 134 is maintained at a given position by biased retainer 142 shown in FIG. 9B receivable in detents 132. Biased retainer 142 is urged toward detents 132 by spring 144 housed within slide 134. Spring 144 maintains enough pressure against retainer 142 to maintain slide 134 in a given position within detents 132, but is resilient enough to respond to efforts to move slide 134 to a new position by the application of force by a user.

Referring again to FIG. 9A through 9F, slide 134 is shown in three different placements along the vertical portion 124 of mounting plate 126. As shown in FIG. 9D, when slide 134 is spaced maximally from horizontal portion 146 of mounting plate 126, maximum resistance to pivotal motion is achieved. As shown in FIG. 9E, when slide 134 is placed in a position nearer to horizontal portion 146, a medium resistance to pivotal motion is achieved, while, as shown in FIG. 9F, where slide 134 is placed nearest horizontal member 146, a minimum resistance to pivotal motion is achieved.

In FIGS. 10A through 10G a fourth embodiment of the load distributing waist harness assembly is shown, wherein most elements of the assembly are similar to those shown in FIGS. 4 and 5. However, vertical portion 148 of mounting plate 150 is shown to include apertures 152, as shown in FIG. 10A. As may be seen in FIG. 10B, wherein left void 152 is shown, apertures 152 include detents 154, and may be capped by removable plugs 156. Referring again to FIG. 10A, expansion compression springs 158 are indicated in ghosted fashion in any of three locations along apertures 152.

As shown in FIG. 10D, expansion compression springs 158 include hooks 160 at both ends (only one end of which is shown in FIG. 10D). Hooks 160 are receivable in detents 154 (shown in FIG. 10B) within vertical portion 148 of mounting plate 150 while, at the other end of springs 158, hooks 160 are received in receiving holes 162 within external frame portion 58. Upon receipt by detents 154 of hook 160 of spring 158, plug 156 may be placed within apertures 152 thereby retaining hooks 160 against detachment by sudden jarring or the like (as shown in FIG. 10C).

As shown in FIG. 10E, when springs 158 are placed in the uppermost detents 154 of apertures 152, and in the uppermost of holes 162 in frame portion 58, maximum resistance to pivotal motion of mounting plate 150 is achieved. As shown in FIG. 10F, where springs 158 are attached between the middle detents 154 and the middle mounting holes 162, a medium restriction of pivotal motion of mounting plate 150 is achieved, while, as shown in FIG. 10G, where springs 158 are connected between the lowest of the detents 154 and mounting holes 162, minimum resistance to pivotal motion of mounting plate 150 is achieved.

Upper pack stabilizing assembly 164 is best shown in FIGS. 11 and 12. Referring to FIG. 4, where upper stabilizing assembly 164 is shown together with the preferred embodiment of load distributing waist harness assembly 36, upper pack stabilizer assembly 164 is shown to include frame members 46. As shown in FIG. 11, frame member 46 is a guide including a scalloped rear portion 166, over which slidable height adjustment assembly 48 is maintained.

Slidable height adjustment portion 48 (as shown in FIG. 12), includes a U-shaped housing portion 168 having a mating inner portion 170 therein. Height adjustment portion 48 also includes cam 172 connected to housing portion 168 by mounting pin 174 within ears 176 on either side of housing portion 168. Webbing 178 is maintained at the lower portion of housing 168 around pin 180 through lower ears 182 and 184. Webbing 178 is connected by buckle 52 to strap 54, the length of strap 54 being adjustable thereby, and strap 54 is connected to shoulder harness pads 22 (as shown in FIG. 2) as for example, by stitching.

As shown in FIG. 12, upon release of cam 172 housing 168, which acts in a clamping fashion, is released, thereby achieving a spaced relationship between scalloped mating portion 170 in housing 168 and scalloped portion 166 of frame members 46, thereby allowing upper stabilizing assembly 164 motion along the length of frame member 46. When the housing 168 is raised to a higher position on frame member 46, buckle 52 allows a lengthening of strap 54 in response thereto. When housing 168 is lowered on frame member 46, buckle 52 allows a tightening of strap 54 in response thereto. When adjustment of the height of housing 168 is achieved, cam member 172 is closed thereby clamping housing 168 and bringing scalloped portion 166 and 170 into a mating relationship.

Since maximum stability of the upper portion of the frame pack is achieved by minimizing the length of straps 54, thereby shortening the radius of any potential swaying motion, it is to be appreciated that the readily adjustable upper stabilizing assembly 164 is desirable for response to the variable placement of yoke 28, and therefore shoulder harness assembly 18, along vertical frame member 32 (as shown in FIG. 4). Additionally, less restriction of shoulder movement is achieved by maintaining strap 54 between the shoulders of a user and the attachment point of webbing 178 at an upwardly extending angle from the horizontal no greater than 50 degrees.

When properly adjusted, frame pack 10 responds to the natural movements of a user without undue restriction in the hip and shoulder areas of a user while maintaining and/or enhancing stability of the pack at its upper and lower regions. While not specifically shown, it should be appreciated that frame pack 14 may include either an external or an internal frame structure of various design. Additionally, walls 15 can be configured to form any desirable number of chambers, and may be equipped with various webbings and loops for external attachment of various equipment.

As can be appreciated from the foregoing, this invention provides a frame pack that is particularly adaptable to users of different torso length and which allows a maximum range of hip adn shoulder motion and comfort to a user while maintaining and/or enhancing stability of the frame pack on the user while in use.

What is claimed is:

1. A body mountable structure for retaining articles, said structure comprising:

means for defining an article receptacle;

a frame having an upper portion and a lower portion, with said frame having said means for defining an article receptacle mounted thereon;

mounting means having a first portion adapted to be received over the shoulders of a user, and a second portion connectable with said upper portion of said frame;

load distributing means having a first portion with a first section pivotally mounted on said lower portion of said frame and a second section connectable with said first section of said load distributing means, said second section being adapted to be positioned adjacent to the torso of a user, and said load distributing means having a second portion for limiting pivotal movement of said first portion of said load distributing means with respect to said frame; and stabilizing means having guide means mountable on said frame, adjustment means slidably received on said guide means, and tension adjustable oscillation restraint means connected to both said first portion of said mounting means and said adjustment means.

2. The structure of claim 1 wherein said frame has a central longitudinally extending member, and wherein said mounting means is connectable to a yoke positionable at a plurality of locations along said central member of said frame for adjusting the longitudinally extending distance of the structure to thereby accommodate users of different heights.

3. The structure of claim 1 wherein said frame has a central longitudinally extending member, and wherein said first section of said first portion of said load distributing means is connectable at a plurality of locations along said central member of said frame for said pivotal movement thereat.

4. The structure of claim 1 wherein said frame has peripheral portions, wherein said means for defining an article receptacle includes edge portions adjacent to at least a part of said peripheral portions of said frame, and wherein said structure further includes attaching means having a first section at said edge portions of said means for defining an article receptacle and a second section extending from said first section with said second section including securing means for causing said first section to quickly and releasably maintain said edge portions of said means for defining an article receptacle at said peripheral portions of said frame when said securing means is in the secured position.

5. The structure of claim 4 wherein said edge portions of said means for defining an article receptacle has a channel formed thereat that extends beyond said peripheral portions of said frame, wherein said first section of said attaching means includes a cable received in said channel formed at said edge portions of said means for defining an article receptacle, and wherein said securing means includes cooperating buckle means connected to the opposite ends of said cable, whereby said cable draws said edge portions of said means for defining an article receptacle tightly around said peripheral portions of said frame when said buckle means is brought into the secured position to place tension on said cable, with release of said buckle means from the secured position allowing quick release of said edge portions from around said peripheral portions of said frame due to release of tension on said cable.

6. The structure of claim 1 wherein said frame has a longitudinally extending and centrally positioned first member, wherein said lower portion of said frame has a second frame member that extends substantially normal to said first member, said lower portion of said frame also having side members that extend upwardly from the end portions of said second frame member, and wherein said first section of said first portion of said load distributing means is mounted at the center of said second frame member.

7. The structure of claim 6 wherein said first section of said first portion of said load distributing means is an inverted substantially T-shaped member one portion of which extends substantially normal to said first member for substantially the entire width of the lower back of a user.

8. The structure of claim 7 wherein said second portion of said load distributing means is a resilient means variably positionable along said first member of said frame and along the portion of said T-shaped member that extends in a direction substantially parallel to said first member, said T-shaped member being mountable to said frame at the intersection of said portions of said T-shaped member.

9. The structure of claim 6 wherein said first section of said first portion of said load distributing means includes a substantially rectangular member which extends a distance normal to said first frame member substantially equal to that of the width of the lower back of a user, said rectangular member being curved to fit the lower back of the user, and wherein said second portion of said load distributing means includes a plurality of resilient bands, each of which bands is variably positionable about said rectangular member and said second frame member at said lower portion of said frame, said rectangular member being mountable to said frame at the center position thereof with respect to the length of said rectangular member.

10. The structure of claim 7 wherein said T-shaped member includes a portion that extends substantially parallel to said first frame member and has a plurality of spaced positioning members extending therealong, and wherein said second portion of said load distributing means includes slidable means having spacer means receivable at each of said spaced positioning members, said slidable means being received by said spaced positioning members and by said first frame member of said lower portion of said frame for variably positioning said slidable means with respect to said spaced positioning members.

11. The structure of claim 7 wherein said T-shaped member has a portion that extends substantially parallel to said first frame member, with said portion having anchor means therein, and wherein said second portion of said load distributing means comprises resilient means connected with said anchor means at one end of said resilient means and at said side members of said lower portion of said frame at the other end of said resilient means.

12. The structure of claim 11 wherein said structure includes removable plug means insertable into said anchor means after receipt therein of said one end of said resilient means.

13. The structure of claim 10 wherein said first frame member has edge portions having a plurality of detents therein, said edge portion being substantially coextensive with said plurality of spaced positioning members, and wherein said slidable means includes retainer means having biasing means for urging said retainer means into said detents.

14. The structure of claim 1 wherein said oscillation restraint means extends upwardly from said first portion of said mounting means at an angle no greater than about fifty degrees from horizontal when said structure is positioned with said frame upright with said upper portion above said lower portion.

15. The structure of claim 1 wherein said structure is an external frame backpack.

16. A body mountable structure for retaining articles, said structure comprising:

means for defining an article receptacle;

a frame having an upper portion and a lower portion extending along the longitudinal axis of the frame with the frame in an upright position, and said frame having said means for defining an article receptacle mounted thereon;

mounting means connectable with the upper portion of said frame; and load distributing means having first means with a first portion pivotably mounted on said lower portion of said frame, and a second portion extending from said first portion in a direction substantially parallel to the longitudinal axis of said frame, said load distributing means also including belt means releasably connectable to said first means, and movement limiting means positionable at various locations on both said second portion of said first means and on said frame for causing resistance to movement of said first portion of said first means, whereby, when said belt means is positioned around the torso of a user, said first portion of said first means responds to the natural motion of a user without undue restriction thereof and said movement limiting means stabilizes said first portion of said first means and said structure against sudden and excessive movement which could destabilize a user.

17. The structure of claim 16 wherein said frame has a longitudinally extending and centrally positioned first member, wherein said lower portion of said frame has a second frame member that extends substantially normal to said first frame member, said lower portion of said frame also having side members that extend upwardly from the end portions of said second frame member, and wherein said first portion of said first means of said load distributing means is mounted at the center of said second frame member.

18. The structure of claim 17 wherein said first portion of said first means of said load distributing means is an inverted T-shaped member one portion of which extends substantially normal to said first member for substantially the entire width of the lower back of a user.

19. The structure of claim 18 wherein said movement limiting means of said load distributing means is a resilient means variably positionable along said first member of said frame and along the portion of said T-shaped member that extends in a direction substantially parallel to said first member, said T-shaped member being mountable to said frame at the intersection of said portions of said T-shaped member.

20. The structure of claim 17 wherein said first portion and said first section of said load distributing means includes a substantially rectangular member which extends a distance normal to said first frame member substantially equal to that of the width of the lower back of a user, said rectangular member being curved to fit the lower back of the user, and wherein the second portion of said load distributing means includes a plurality of resilient bands, each of which bands is variably positionable about said rectangular member and said second frame member of said lower portion of said frame, said rectangular member being mountable to said frame at the center position thereof with respect to the length of said rectangular member.

21. The structure of claim 18 wherein said vertical portion of said T-shaped member includes a portion that extends substantially parallel to said first frame member and has a plurality of spaced positioning members extending therealong, and wherein said second movement limiting means of said load distributing means includes slidable means having spacer means receivable at each of said spaced positioning members, said slidable means being received by said spaced positioning members and by said first frame member of said lower portion of said frame for variably positioning said slidable means with respect to said spaced positioning members.

22. The structure of claim 21 wherein said first frame member has edge portions having a plurality of detents therein, said edge portion being substantially coextensive with said plurality of spaced positioning members, and wherein said slidable means includes retainer means having biasing means for urging said retainer means into said detents.

23. The structuue of claim 18 wherein said T-shaped member has a portion that extends substantially parallel to said first frame member, with said portion having anchor means therein, and wherein said second movement limiting means of said load distributing means comprises resilient means connected with said anchor means at one end of said resilient means and at said side members of said lower portion of said frame at the other end of said resilient means.

24. The structure of claim 23 wherein said structure includes removable plug means insertable into said anchor means after receipt therein of said one end of said resilient means.

25. The structure of claim 16 wherein said structure includes stabilizing means having guide means mountable on said frame, adjustment means slidably received on said guide means, and tension adjustable oscillation restraint means connected to both said mounting means and said adjustment means.

26. A body mountable structure for retaining articles, said structure comprising:

means for defining an article receptacle;

a frame having an upper portion and a lower portion, with said frame having said means for defining an article receptacle mounted thereon;

mounting means having a first portion to be received over the shoulders of a user, and a second portion connectable with said upper portion of said frame; and stabilizing means including slidable clamping means having a clamping portion and a camming portion for closing and opening said clamping portion, guide means having an engagement portion engagable with said clamping portion of said slidable clamping means upon closing of said clamping portion by said camming portion with said guide means being moutable on said upper portion of said frame, and oscillation restraint means connectable to and extending between both said first portion of said mounting means and said clamping means, said restraint means having adjustment means for adjusting the length of said restraint means between said first portion of said mounting means and said clamping means whereby, upon adjustment of said adjustment means, said stabilizing means may be readily adjusted by movement of said slidable clamping means along said guide means to minimize restriction of shoulder movement while maximizing stability of said upper portion of said frame by minimizing the length of said oscillation restraint means between said first portion of said mounting means and said frame by manipulation of said adjustment means.

27. The structure of claim 26 wherein said frame has a central member and wherein said mounting means is connectable to a yoke positionable at a plurality of locations on said central member of said frame for adjusting the structure relative to the height of a user.

28. The structure of claim 26 wherein said oscillation restraint means extends upwardly from said first portion of said mounting means at an angle no greater than about fifty degrees from horizontal when said stucture is positioned with said frame upright with said upper portion above said lower portion.

29. The structure of claim 26 wherein said structure includes load distributing means having a first portion with a first section pivotably mountable on said lower portion of said frame and a second section connectable with said first section of said load distributing means for positioning around the torso of a user, and a second portion connected with both said first section of said first portion of said load distributing means and to said frame for variably limiting pivotal movement of said first section of said first portion of said load distributing means relative to said frame.

* * * * *

UNITED STATES PATENT AND TRADEMARK OFFICE

CERTIFICATE OF CORRECTION

PATENT NO. : 4,676,418

DATED : June 30, 1987

INVENTOR(S) : Greg E. Lowe

It is certified that error appears in the above-identified patent and that said Letters Patent is hereby corrected as shown below:

Column 4, line 54, "portoins" should be --portions--.

Column 4, line 59, "2" should be --72--.

Column 5, line 43, "or" should be --of--.

Column 5, line 50, "grippin" should be --gripping--.

Column 5, line 53, "incldues" should be --includes--.

Column 7, line 39, "adn" should be --and--.

Column 10, line 45, "second portion" should be --movement limiting means--.

Column 10, line 45, "the" (second usage) should be --said--.

UNITED STATES PATENT AND TRADEMARK OFFICE

CERTIFICATE OF CORRECTION

PATENT NO. : 4,676,418

DATED : June 30, 1987

INVENTOR(S) : Greg E. Lowe

It is certified that error appears in the above-identified patent and that said Letters Patent is hereby corrected as shown below:

Column 10, line 53, "said" should be --the--.

Column 11, line 4, "structuue" should be --structure--.

Column 11, line 40, "moutable" should be --mountable--.

Signed and Sealed this

Seventeenth Day of November, 1987

*Attest:*

DONALD J. QUIGG

*Attesting Officer*

*Commissioner of Patents and Trademarks*